US006305188B1

(12) United States Patent
Park

(10) Patent No.: US 6,305,188 B1
(45) Date of Patent: Oct. 23, 2001

(54) REFRIGERATOR

(75) Inventor: Jung-hee Park, Anyang (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/685,611

(22) Filed: Oct. 11, 2000

(30) Foreign Application Priority Data

Feb. 21, 2000 (KR) ..... 2000-8227

(51) Int. Cl.[7] ..... F25B 41/00
(52) U.S. Cl. ..... 62/513
(58) Field of Search ..... 62/513, 258, 498

(56) References Cited

U.S. PATENT DOCUMENTS 2,530,648 * 11/1950 Cahenzli et al. ..... 62/513
2,776,552 * 1/1957 Thomas ..... 62/513
2,785,542 * 3/1957 Thomas ..... 62/513
3,145,545 * 8/1964 Jaeger ..... 62/513
3,566,615 * 3/1971 Roeder ..... 62/513
4,147,037 * 4/1979 Gelbard et al. ..... 62/113
5,797,277 * 8/1998 Hong et al. ..... 62/285
5,819,548 * 10/1998 Clawson ..... 62/225

* cited by examiner

*Primary Examiner*—William C. Doerrler
(74) *Attorney, Agent, or Firm*—Larson & Taylor PLC

(57) ABSTRACT

Disclosed is a refrigerator comprising a compressor, a condenser for condensing a refrigerant from the compressor into a liquid state, an evaporator for evaporating the liquid refrigerant into a gaseous state through a heat exchange with an air within a storage, a capillary tube positioned between the evaporator and the condenser, a connection pipe positioned between the evaporator and the connection pipe; and coupling members positioned between the evaporator and the connection pipe and positioned between the connection pipe and the compressor, for directing the capillary tube to the inside of the connection pipe. With this configuration, a liquid refrigerant in a gaseous refrigerant flowing into the compressor from the evaporator can be effectively removed, without soldering of the capillary tube and the connection pipe.

2 Claims, 4 Drawing Sheets

REFRIGERATOR

BACKGROUND OF THE INVENTION

1. Field of the Invention

This invention relates in general to refrigerators, and more particularly, to a refrigerator having a refrigerant circulatory system capable of effectively removing a liquid refrigerant in a gaseous refrigerant transferred to a compressor from an evaporator.

2. Description of Related Art

Referring to FIG. 4, which is a schematic view of a refrigerant circulatory system of a conventional refrigerator, the refrigerant circulatory system of the refrigerator is comprised of a compressor 111 for compressing a refrigerant with high-temperature and high-pressure, a condenser 121 for condensing the gaseous refrigerant transferred from the compressor 111 into a liquid state, and an evaporator 131 for evaporating the liquid refrigerant to cause heat exchange between the evaporated refrigerant and an air in a storage 141.

The refrigerant circulatory system is comprised of a capillary tube 104 installed between the condenser 121 and the evaporator 131, being used as a passage of the liquid refrigerant flowing into the evaporator 131 from the condenser 121, and a connection pipe 109 installed between the evaporator 131 and the compressor 111, being used as a passage of the gaseous refrigerant flowing into the compressor 111 from the evaporator 131.

A small amount of the liquid refrigerant which is not evaporated is mixed in the gaseous refrigerant of low temperature which is flowing into the compressor 111 after heat exchange through the evaporator 131. The liquid refrigerant flowing into the compressor 111 makes a bad effect on the pumping operation of the compressor 111 for compressing the gaseous refrigerant into high-temperature and high-pressure state. Thus, to enhance the efficiency of the refrigerator, the liquid refrigerant in the gaseous refrigerant has to be removed.

To remove the liquid refrigerant in the gaseous refrigerant, the connection pipe 109 positioned between the compressor 111 and the evaporator 131 is contacted by soldering with the capillary tube 104 positioned between the condenser and the evaporator 131, according to the conventional system. With this structure, heat is transferred from the capillary tube 104 through which the liquid refrigerant of high-temperature passes to the connection pipe 109 through which the gaseous refrigerant of low temperature passes, whereby the liquid refrigerant in the gaseous refrigerant in the connection pipe 109 is evaporated into a gaseous state.

As described above, since the connection pipe and the capillary tube are coupled by soldering in the conventional system, the longer the pipe and the tube, the larger soldering they need in coupling. Also, since lead for soldering is harmful to human's body, this would cause to destroy the concerned personnel's health According to another conventional refrigerant circulatory system, a connection pipe positioned between an evaporator and a compressor has two holes spacedly formed thereon at a predetermined distance through which a capillary tube passes the inside of the connection tube.

However, this arrangement is still problematic in that the connection pipe is coupled by soldering with the capillary tube at the holes thereof, which bears the same problem as above.

SUMMARY OF THE INVENTION

Accordingly, the present invention has been made keeping in mind the above problems occurring in the prior art, and an object of the present invention is to provide a refrigerator having an improved refrigerant circulatory system wherein the coupling of the connection pipe and a capillary tube are improved, thereby effectively removing a liquid refrigerant in a gaseous refrigerant flowing into a compressor from an evaporator.

In order to achieve the above object, the present invention provides a refrigerator comprising a compressor, a condenser for condensing a refrigerant from the compressor into a liquid state, an evaporator for evaporating the liquid refrigerant into a gaseous state through a heat exchange with an air within a storage, a capillary tube positioned between the evaporator and the condenser, a connection pipe positioned between the evaporator and the connection pipe, and coupling members positioned between the evaporator and the connection pipe and positioned between the connection pipe and the compressor, for directing the capillary tube to the inside of the connection pipe.

The coupling members comprises a first coupling element functioning as a passage for the refrigerant, a second coupling element functioning as a passage for the capillary tube, and a connecting element for connecting the first coupling element and the second coupling element.

The first and second coupling elements of the coupling member are disposed in parallel with each other.

The first coupling element has a first end screw-coupled together with an inlet of the compressor or an outlet of the evaporator and a second end screw-coupled with the connection pipe.

The second coupling element has an open end sealingly coupled to the capillary tube and a closed end.

The first and second coupling elements of the coupling member are of a T-shape.

The first coupling element has a first end screw-coupled together with an inlet of the compressor or an outlet of the evaporator and a second end screw-coupled with the connection pipe.

The second coupling element has an open end sealingly coupled to the capillary tube.

BRIEF DESCRIPTION OF THE DRAWINGS

The present invention will be better understood and its various objects and advantages will be more fully appreciated from the following description taken in conjunction with the accompanying drawings, in which.

PREFERRED EMBODIMENTS CARRYING OUT THE INVENTION

Figure 1:
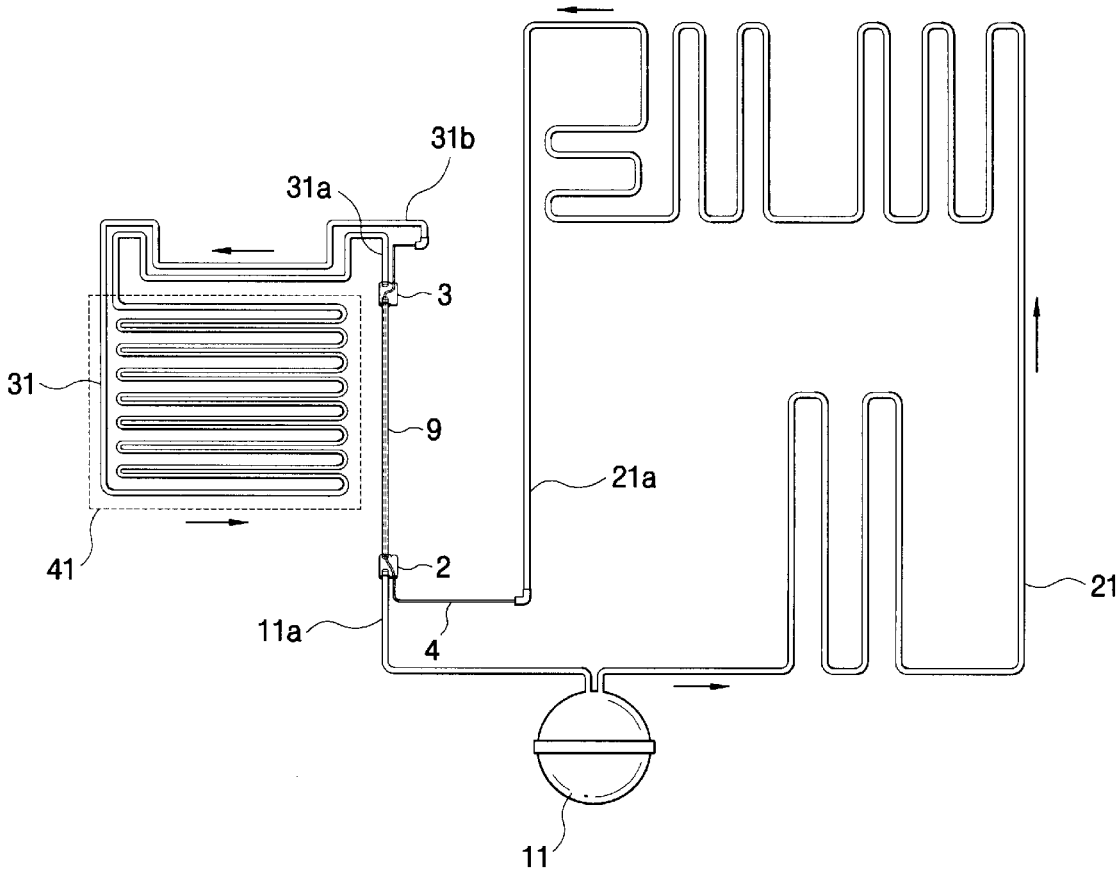
FIG. 1 is a schematic view of a refrigerant circulatory system of a refrigerator according to one embodiment of the present invention.

Referring to FIG. 1, a refrigerant circulatory system of a refrigerator is comprised of a compressor 11 for compressing a refrigerant into the refrigerant of high temperature and high pressure, a condenser 21 for condensing the refrigerant from the compressor into a liquid state, and an evaporator 31 for evaporating the liquid refrigerant and allowing the evaporated refrigerant to cause heat exchange with an air within a storage 41.

A condenser outlet pipe 21*a* is provided at the condenser 21 for supplying the refrigerant of high temperature and high pressure to the evaporator 31. An inlet pipe 31*b* and an outlet pipe 31*a* are provided at the evaporator 31, the inlet pipe 31*b* for directing the liquid refrigerant of high temperature and high pressure to flow into the evaporator 31, and the outlet pipe 21*b* for directing the gaseous refrigerant of low temperature and low pressure after having passed through the evaporator 31 to the compressor 11.

Between the condenser outlet pipe 21*a* and the evaporator inlet pipe 31*b* is positioned a capillary tube 4 functioning as a passage allowing the liquid refrigerant to flow into the evaporator 31 from the condenser 21. Between the evaporator 31 and the compressor 11 is positioned a connection pipe 9 functioning as a passage allowing the gaseous refrigerant to flow into the compressor 11 from the evaporator 31.

At opposite end portions of the respective capillary tube 4 and connection pipe 9 are provided coupling members 2 and 3 interconnecting the evaporator 31, the condenser 21 and the compressor 11. The coupling member 3 on the side of the evaporator 3 interconnects the evaporator outlet pipe 31*a,* the connection pipe 9 and the capillary tube 4 whereas the coupling member 2 on the side of the compressor 11 interconnects a compressor inlet pipe 11*a,* the connection pipe 9 and the capillary tube 4.

The capillary tube 4 coupled to the condenser outlet pipe 21*a* at one end thereof is inserted into the compressor coupling member 2 to pass through the connection pipe 9 and subsequently through the evaporator coupling member 3, and is finally coupled to the evaporator inlet pipe 31*b* at the other end thereof.

The compressor coupling member 2, the connection pipe 9 and the evaporator coupling member 3 will be described in more detail hereinbelow referring to FIGS. 2 and 3.

Figure 2:
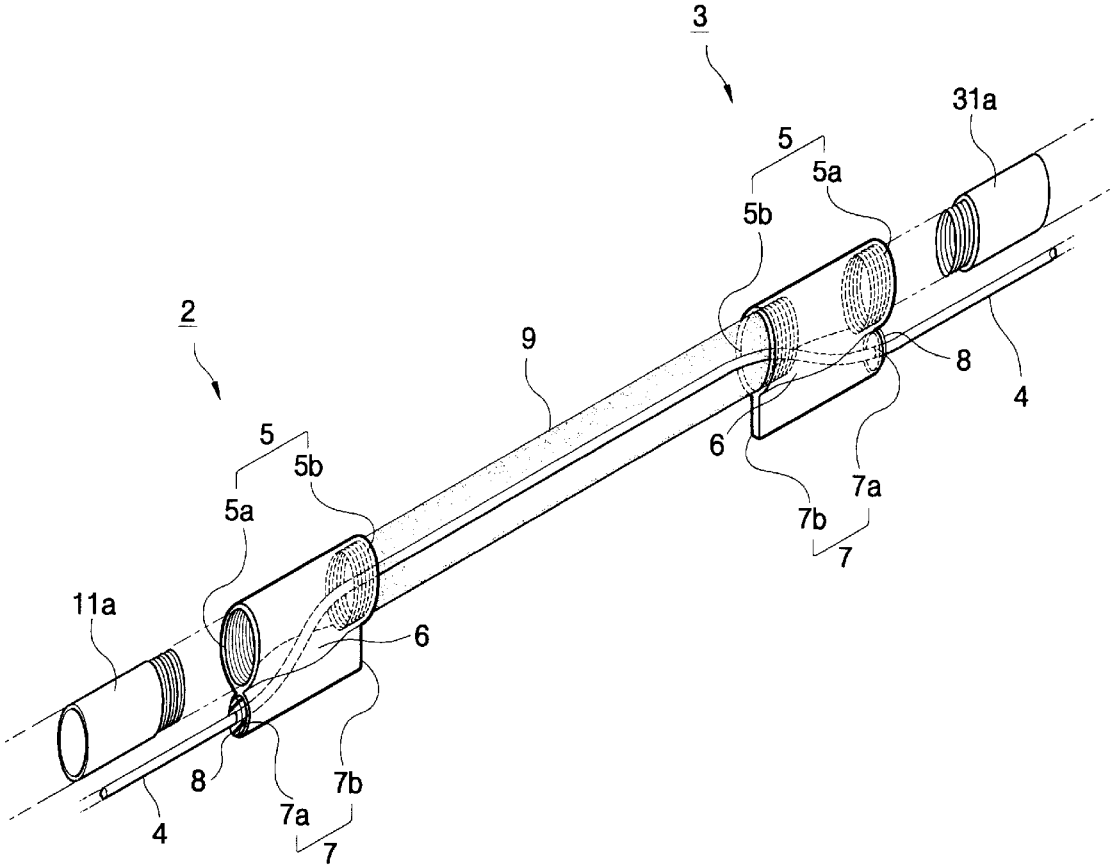
FIG. 2 is an enlarged perspective view partially showing a main part of the refrigerant circulatory system of FIG. 1.

Referring to FIG. 2, the compressor coupling member 2 is comprised of a first coupling element 5 having open ends 5*a* and 5*b* inside of which female screws are provided, a second coupling element 7 having an open end 7*a* and having a closed end 7*b,* being positioned in parallel with the first coupling element 5, and a connecting element 6 communicating the first coupling element 5 and the second coupling element 7, being provided between the first coupling element 5 and the second coupling element 7.

The evaporator coupling member 3 has the same configuration as the compressor coupling member 2. Thus, the description thereof will be omitted.

On opposite end portions of the connection pipe 9 are formed male screws, which are coupled to the female screws formed in the compressor coupling member 2 and the evaporator coupling member 3.

The compressor coupling member 2 and the evaporator coupling member 3 are symmetrically positioned and the connection pipe 9 is positioned therebetween. That is, the opposite ends of the connection pipe 9 are coupled to the second ends 5*b* of the first coupling elements 5 of the coupling members 2 and 3. The first end 5*a* of the compressor coupling member 2 is coupled to the compressor inlet pipe 11*a* by the male screw formed on its end portion whereas the first end 5*a* of the evaporator coupling member 3 is coupled to the evaporator outlet pipe 31*a* by the male screw formed on its end portion.

The capillary tube 4 connected to the condenser outlet pipe 21*a* is inserted into the open end 7*a* of the second coupling element 7 of the compressor coupling member 2 to pass through the connecting element 6 and then through the second end 5*b* of the first coupling element 5, and finally reach the second end 5*b* of the coupling element 5 of the evaporator coupling member 3 via the inside of the connection pipe 9.

The capillary tube 4 having passed through the second end 5*b* is connected to the evaporator inlet pipe 31*b,* passing the open end 7*a* of the second coupling element 7 of the evaporator coupling member 3 after passing through the connecting element 6 of the evaporator coupling member 3.

In the open end 7*a* of each second coupling element 7 of the respective coupling members 2 and 3 is installed a packing 8 for preventing leakage of the refrigerant flowing in the inside of the coupling members 2 and 3.

Figure 3:
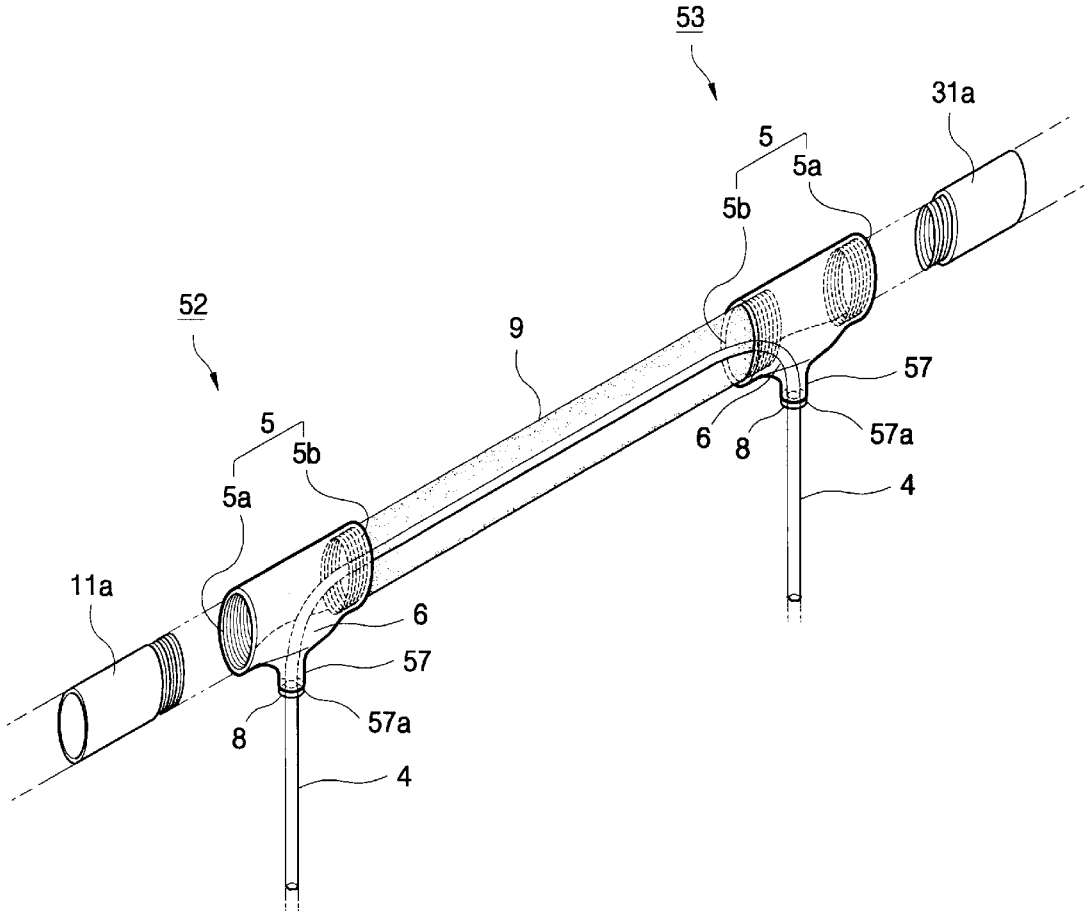
FIG. 3 is an enlarge perspective view partially showing a main part of a refrigerant circulatory system of a refrigerator according to another embodiment of the present invention.
Figure 4:
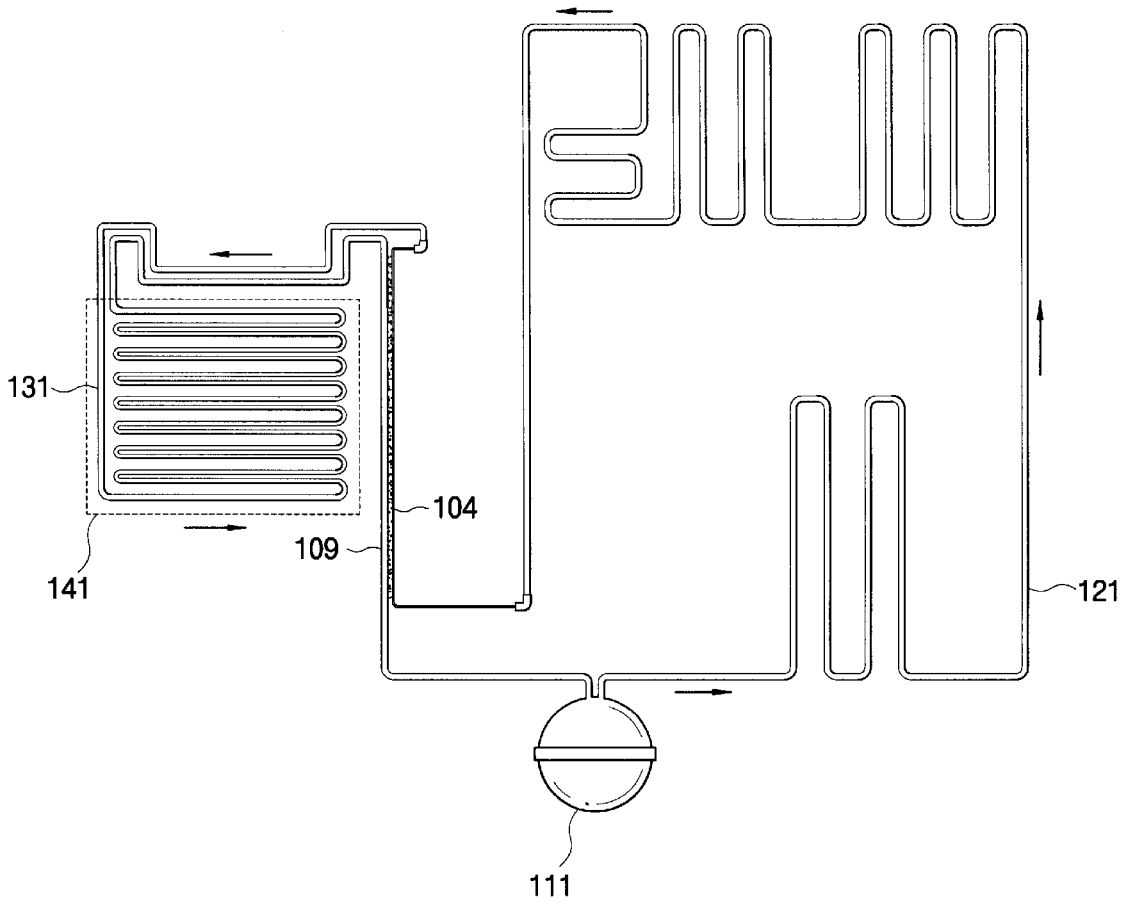
FIG. 4 (PRIOR ART)
FIG. 4 is a schematic view of a refrigerant circulatory system of a conventional refrigerator.

Referring to FIG. 3, a compressor coupling member 52 according to a second embodiment of the present invention is comprised of a first coupling element 5 having female screws provided in opposite end portions thereof, a second coupling element 57 having an open end 57*a,* disposed perpendicular to the first coupling element 5, and a connecting element 6 connecting the first coupling element 5 and the second coupling element 57. The evaporator coupling member 53 has the same configuration as the compressor coupling member 52. Thus, the description thereof is omitted.

On opposite end portions of the connection pipe 9 are formed male screws, which are coupled to the respective second ends 5*b* of the compressor coupling member 52 and the evaporator coupling member 53. The compressor coupling member 52 and the evaporator coupling member 53 are symmetrically positioned and the connection pipe 9 is positioned therebetween. The first end 5*a* of the compressor coupling member 52 is coupled to the compressor outlet pipe 11*a* having a male screw formed on its end portion, the fist end 5*a* of the evaporator coupling member 53 is coupled to the evaporator inlet pipe 31 having a male screw formed in its end.

As illustrated in FIG. 3, the capillary tube 4 is inserted into the open end 57*a* of the second coupling element 57 of the compressor coupling member 52 to pass through the connecting element 6 and then through the second end 5*b* of the first coupling element 5, and finally reach the second end 5*b* of the evaporator coupling member 53 via the inside of the connection pipe 9. The capillary tube 4 having passed through the second end 5*b* is connected to the evaporator inlet pipe 31*b,* passing through the open end 57*a* after passing through the connecting element 6 of the evaporator coupling member 53.

In the open end 57*a* of each second coupling element 57 is installed a packing 8 for preventing leakage of the refrigerant flowing in the inside of the compressor coupling members 52 and the evaporator coupling member 53.

With this configuration, the gaseous refrigerant of high temperature and high pressure, compressed through a pumping operation of the compressor 11 is liquefied by the condenser 21 and the liquefied refrigerant is supplied into the evaporator 31 through the capillary tube 4.

The gaseous refrigerant evaporated in the evaporator 31 performs heat exchange in the storage 41 and then sequentially passes the evaporator coupling members 3 and 53, the connection pipe 9 and the compressor coupling members 2 and 52 wherein the capillary tube 4 functions as the passage allowing the refrigerant of high temperature and high pressure to flow.

The liquid refrigerant in the gaseous refrigerant within the connection pipe 9 is removed owing to heat conduction by the capillary tube 4 inserted inside of the connection pipe 9, and then the refrigerant is supplied again to the compressor 11.

As described above, according to the present invention, there is provided a refrigerator wherein the liquid refrigerant in the gaseous refrigerant flowing into the compressor from the evaporator can be effectively removed, without soldering of the capillary tube and the connection pipe.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A refrigerator having improved cooling system comprising:

a compressor;

a condenser for condensing a refrigerant from the compressor into a liquid state;

an evaporator for evaporating the liquid refrigerant into a gaseous state through heat exchange with air within a storage area;

a capillary tube positioned between the evaporator and the condenser;

a connection pipe positioned between the evaporator and the compressor; and first and second coupling members, positioned between the evaporator and the connection pipe and positioned between the connection pipe and the compressor, respectively, for directing the capillary tube to the inside of the connection pipe, each of the coupling members comprising a first coupling element functioning as a passage for the refrigerant, a second coupling element functioning as a passage for the capillary tube, and a connecting element for connecting the first coupling element and the second coupling element, the axes of the second coupling elements of the coupling members extending parallel to the axes of the respective first coupling elements of the coupling members, the first coupling element of the second coupling member having a first end screw-coupled to an inlet of the compressor and a second end screw-coupled with the connection pipe, the first coupling element of the first coupling member having a first end connected to an outlet of the evaporator and a second end screw-coupled to the connection pipe, and the second coupling element of each of the coupling members having an open end sealingly coupled to the capillary tube and a closed end.

2. A refrigerator having improved cooling system comprising:

a compressor;

a condenser for condensing a refrigerant from the compressor into a liquid state;

an evaporator for evaporating the liquid refrigerant into a gaseous state through heat exchange with air within a storage area;

a capillary tube positioned between the evaporator and the condenser;

a connection pipe positioned between the evaporator and the compressor; and first and second coupling members, positioned between the evaporator and the connection pipe and positioned between the connection pipe and the compressor, respectively, for directing the capillary tube to the inside of the connection pipe, each of the coupling members comprising a first coupling element functioning as a passage for the refrigerant, a second coupling element functioning as a passage for the capillary tube, and a connection element for connecting the first coupling element and the second coupling element, the first and second coupling elements of each of the coupling members together forming a T-shaped configuration, the first coupling element of the second coupling member having a first end screw-coupled together with an inlet of the compressor and a second end screw-coupled with the connection pipe, the first coupling element of the first coupling member having a first end connected to an outlet of the evaporator and a second end screw-coupled to the connection pipe, and the second coupling element of each of said coupling members having an open end sealingly coupled to the capillary tube.

* * * * *